US005454202A

United States Patent [19]

van der Weijden

[11] Patent Number: 5,454,202

[45] Date of Patent: Oct. 3, 1995

[54] FLAGPOLE ASSEMBLY WITH ANTI-THEFT PROTECTION

[75] Inventor: Johannes M. van der Weijden, Bodegraven, Netherlands

[73] Assignee: Limeta B.V., Netherlands

[21] Appl. No.: 242,279

[22] Filed: May 13, 1994

[30] Foreign Application Priority Data

May 19, 1993 [NL] Netherlands ..... 9300872
Mar. 24, 1994 [NL] Netherlands ..... 9400468

[51] Int. Cl.[6] ..... E04H 12/32

[52] U.S. Cl. ..... 52/736.1; 116/173; 70/57; 52/40; 52/726.3

[58] Field of Search ..... 52/720, 726.3, 52/732.1, 298, 745.17; 116/173, 174; 70/14, 34, 202, 203, 57, 58, 259

[56] References Cited

U.S. PATENT DOCUMENTS

| | | | |
|---|---|---|---|
| 1,337,237 | 4/1920 | Light | 116/173 |
| 1,645,645 | 10/1927 | Davis | 116/173 |
| 2,225,103 | 12/1940 | Einermann | 116/173 |
| 2,507,623 | 5/1950 | Diaz . | |
| 4,873,851 | 10/1989 | Arnett | 70/259 |
| 5,096,022 | 3/1992 | Bowers | 116/173 X |

FOREIGN PATENT DOCUMENTS

| | | | |
|---|---|---|---|
| 2644501 | 9/1990 | France . | |
| 2672630 | 8/1992 | France . | |
| 2457945 | 6/1976 | Germany . | |
| 8914155 | 2/1990 | Germany . | |
| 9205011 | 6/1992 | Germany . | |
| 0265943 | 9/1927 | United Kingdom | 70/259 |
| 1485096 | 9/1977 | United Kingdom . | |

*Primary Examiner*—Michael Safavi
*Assistant Examiner*—Robert J. Canfield
*Attorney, Agent, or Firm*—Brooks & Kushman

[57] ABSTRACT

The invention relates to a flagpole assembly which at least comprises an at least partially hollow flagpole with a top end and a bottom end, a halyard guided at least partially through the interior of the flagpole, and first halyard fixing means. The flagpole is also provided near the top end thereof with at least one halyard passage opening and first halyard guide means. In the interior of the flagpole the halyard interacts with a halyard weight. Securing means for fixing the position of the halyard weight in the hoisted position of the flag and for preventing unauthorized lowering of the flag are also provided.

7 Claims, 6 Drawing Sheets

FLAGPOLE ASSEMBLY WITH ANTI-THEFT PROTECTION

BACKGROUND OF THE INVENTION

The invention relates to a flagpole assembly, at least comprising an at least partially hollow flagpole with a top end and a bottom end, a halyard guided at least partially through the interior of the flagpole, and first halyard fixing means, the flagpole being provided near its top end with at least a halyard passage opening and first halyard guide means, while in the interior of the flagpole the halyard interacts with a halyard weight.

Such a flagpole assembly is known from U.S. Pat. No. 2,507,623.

A disadvantage of this known flagpole is that theft of the flag is relatively easy, simply by removing the part of the halyard which is outside the pole from the clamp, and then pulling down the flag.

The object of the invention is to provide an improved flagpole assembly which does not have the abovementioned disadvantage, and is characterized in that said flagpole assembly further comprises securing means for preventing unauthorized lowering of the flag and for fixing the position of the halyard weight in at least the hoisted position of the flag.

Special embodiments of the invention are described in the sub-claims.

DESCRIPTION OF THE PREFERRED EMBODIMENTS

Figure 1:
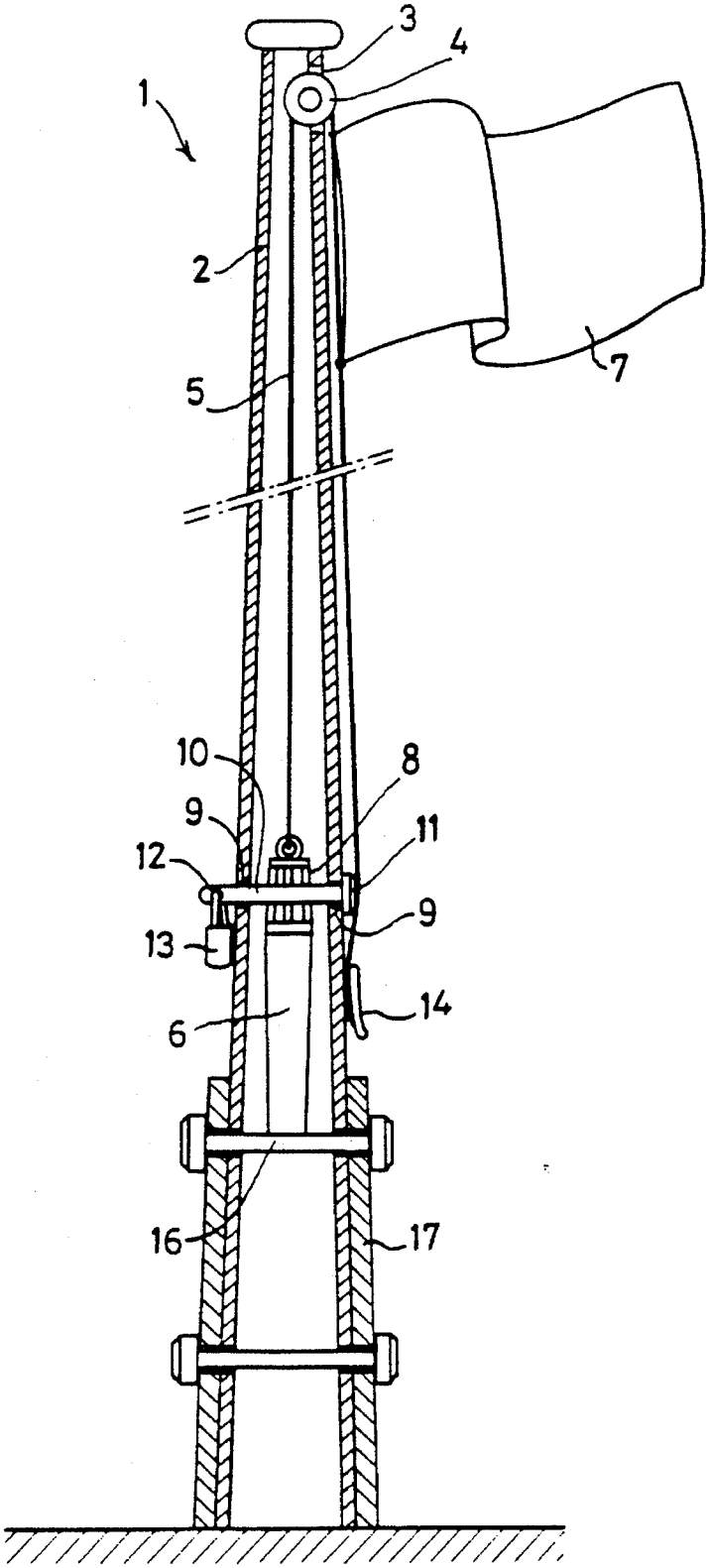
FIG. 1 shows diagrammatically a first embodiment of a flagpole assembly according to the invention.

The first embodiment of the flagpole assembly 1 according to the invention, shown in FIG. 1, comprises a hollow flagpole 2, which can be made of, for example, aluminium or polyester or the like. The flagpole 2 is provided near its top end with an opening 3, through which a halyard 5 is guided from the outside into the flagpole 2 by way of a guide element 4, for example a pulley.

The end of the halyard 5 is fixed to a weight 6 inside the flagpole 2. This weight 6 tapers downwards slightly in the form of a truncated cone, which means that as the weight 6 falls in the flagpole 2, during hoisting of a flag 7, the weight 6 is impeded less by obstacles and uneven parts inside the flagpole 2.

The weight 6 is also provided on its top side with a cage-type structure 8. A locking pin 10 inserted through openings 9 in the wall of the flagpole 2 and through the cage structure 8 prevents vertical displacement of the weight 6, and thus of the flag 7. For this purpose, the locking pin 10 shown is provided at one end with an end part 11 of such dimensions that when the locking pin 10 is inserted through the openings 9, its end part 11 runs against the wall of the flagpole 2. At the other end, the locking pin 10 is provided with an opening 12, through which the shackle of a padlock 13 or the like can be inserted.

A fixing bracket 14 for fixing the halyard 5 is fitted on the outside of the flagpole 2. It can be, for example, a clamp or a so-called clam-cleat.

The procedure which should be followed for hoisting a flag 7 is as follows. First, in order to fix the flag 7 to the halyard 5, the latter should be removed at least partially from the flagpole 2. For this purpose, the locking pin 10 is removed, and the halyard 5 is detached from the fixing bracket 14. The halyard 5 can then be pulled down, so that the weight 6 is moved up. When the halyard 5 has been pulled far enough out of the flagpole 2, something which can be established by, for example, a mark placed on the halyard 5, the flag 7 can be fixed to the halyard 5 by fixing means suitable for the purpose. In the course of this, the halyard 5 must be prevented from being pulled back into the flagpole again under the influence of gravity acting upon the weight 6. Once the flag 7 is fixed, the halyard 5 can be paid out, and the flag 7 is pulled up under the influence of gravity acting upon the weight 6.

Fixing the flag 7 on the halyard 5 at a position indicated by, for example, a mark on the halyard 5 means that the weight 6 will hang correctly with the cage structure 8 at the level of the openings 9 in the flagpole 2 when the flag 7 is hoisted into the desired position.

The correct position of the weight 6 relative to the openings 9 inside the flagpole 2 can also be achieved by allowing the weight 6 to drop until it runs against a stop element disposed at the required level, which element may be, for example, a stay bolt 16 which connects the hollow flagpole 2 to a flagpole sheath 17.

The position of the weight 6 inside the flagpole 2 can now be maintained by again inserting the locking pin 10 through the openings 9 in the wall of the flagpole 2 and through the cage structure 8, and then fitting the padlock 13.

Finally, the part of the halyard 5 outside the flagpole 2 is pulled taut and fixed to the fixing bracket 14.

If anyone tries to steal the flag 7, merely detaching the halyard 5 from the fixing bracket 14 has no effect, since the weight 6 secured inside the flagpole 2 holds the flag 7, but in addition to that the lock 13 of the locking pin 10 would have to be forced.

Figure 2:
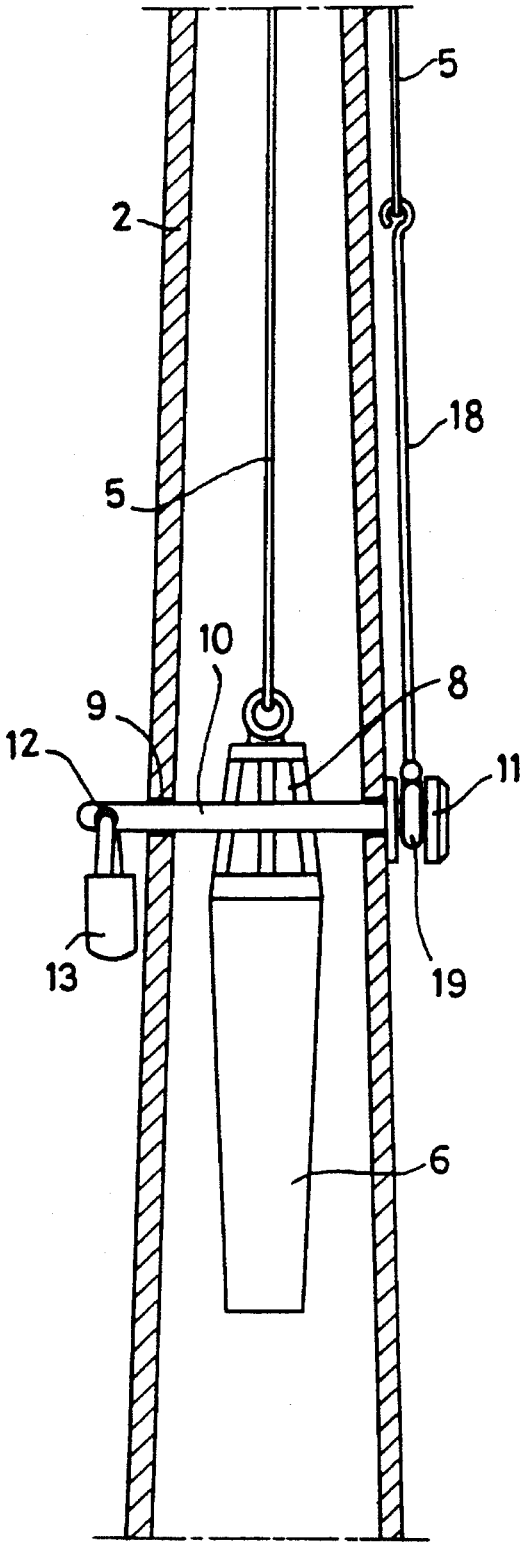
FIG. 2 shows diagrammatically an alternative way of fixing the part of the halyard which is outside the flagpole.

FIG. 2 shows how cutting through the halyard 5 and stealing the flag 7 can be made even more difficult by connecting the end of the halyard 5 which is outside the flagpole 2 in a suitable manner to a sturdy rod 18, made of, for example, stainless steel, which rod at the end away from the end of the halyard 5 is provided with an eye 19 having a diameter which is smaller than the cross-section of the end part 11 of the locking pin 10. In addition, the locking pin 10 can be inserted through this eye 19 before it is inserted through the openings 9 and the cage structure 8 of the weight 6. It goes without saying that the dimensions of the rod 18 and the halyard 5 should in this case be such that when the flag 7 is hoisted the halyard 5 and the rod 18 lie essentially in line with one another, in other words, the halyard 5 is taut.

Figure 3A:
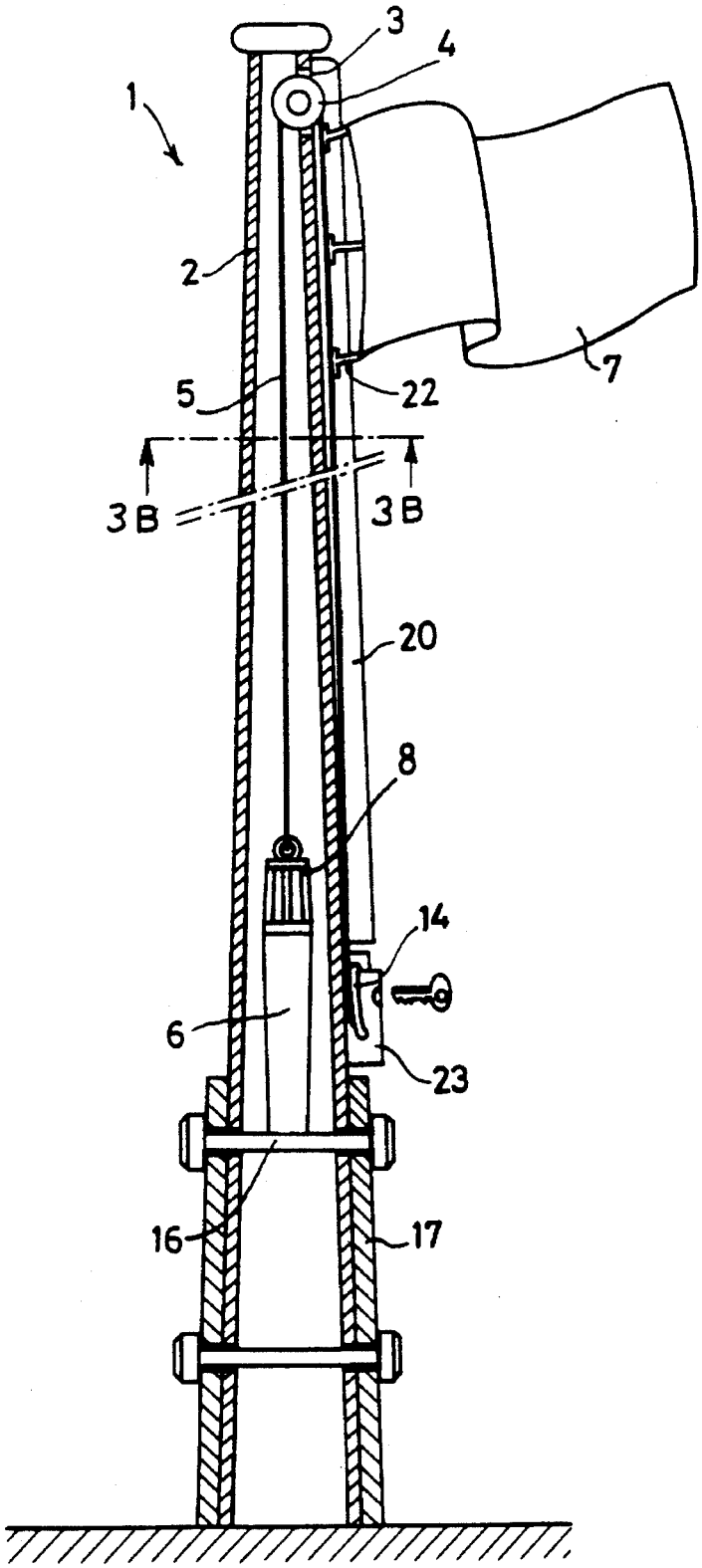
FIG. 3A shows diagrammatically in side view a second embodiment of a flagpole assembly according to the invention.
Figure 3B:
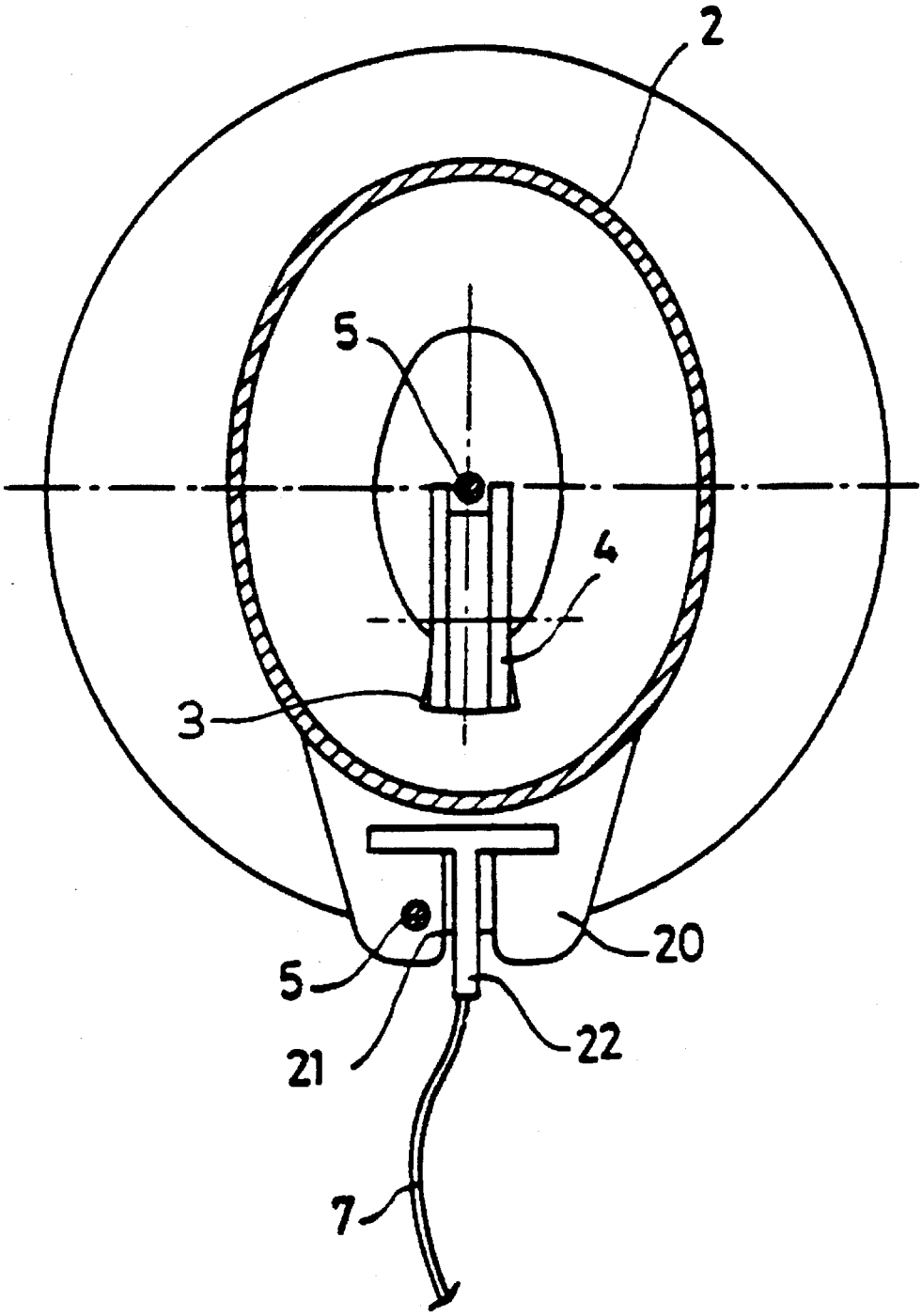
FIG. 3B shows a bottom view of the section along the line B—B of FIG. 3A.

In the exemplary embodiment of a flagpole assembly according to the invention shown in FIGS. 3A and 3B, the parts corresponding to the parts in the exemplary embodiments shown in FIGS. 1 and 2 are given the same reference numbers. In FIG. 3A the part of the halyard 5 which comes out of the pole 2 through the opening 3 and the pulley 4 disposed therein is guided downwards by a guide profile 20 to the fixing bracket 14.

The guide profile 20 extending along the pole from just above the fixing bracket 14 to—in this exemplary embodiment—just beyond the opening 3 can be, for example, the shape shown in FIG. 3B. Guiding the halyard 5 substantially along the full length of the guide profile behind one of the flanges 21 ensures that the halyard is inaccessible from the outside. FIG. 3B shows a view from below into the interior of the flagpole 2, said flagpole having near its top an opening 3 in which the pulley 4 has been rotatably mounted. A halyard 5 has been guided from the inside of the flagpole to over the pulley 4 through the opening 3 into the guide profile 20. The end of the halyard guided through the guide profile 20 ends near the fixing bracket 14 (FIG. 3A).

The guide profile 20 is also such a shape that it can interact with guide elements 22 which are, for example, T-shaped in cross-section. The guide elements 22 are connected to the flag 7 at one side and to the halyard 5 guided through the guide profile 20 at the other side. The guide elements 22 can be fitted on the halyard 5 prior to the hoisting of the flag 7, for example by means of a known clamping connection, following which they are connected to the flag 7, but the guide elements 22 can also be fitted permanently on the halyard 5. Other ways of connecting the flag 7 to the halyard 5 and raising and lowering it by means of the guide profile 20 are also possible; the halyard 5 can, for example, be fed through a hem forming part of the flag 7 and be connected thereto.

For the rest, hoisting and lowering a flag 7 in a flagpole assembly according to this embodiment is carried out in exactly the same way as that described above with reference to FIG. 1.

In order to prevent the halyard 5 from being removed from the fixing bracket 14, provision is also made for a lockable shut-off element 23 which is placed against the flagpole 2 and can be slid upwards along the fixing bracket 14 and partially into and/or over the bottom end of the guide profile 20. After the shut-off element 23 has been positioned, it can be locked by means of, for example, a cylinder lock (not shown) or the like.

Figure 4:
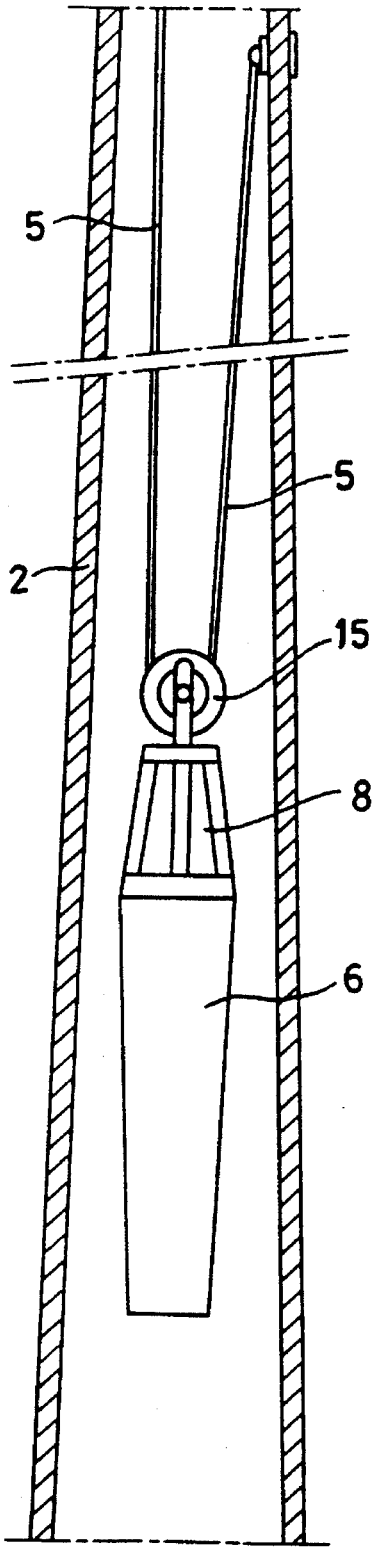
FIG. 4 shows an alternative embodiment of a halyard weight.

FIGS. 1, 2 and 3A show the situation in which the halyard 5 is connected directly to the weight 6, in other words, to the cage structure 8. FIG. 4 shows a slightly modified structure, in which the halyard 5 is fixed in a suitable way to the wall of the flagpole 2 and is guided by means of guide means 15, such as a pulley, fixed on the cage structure 8, to the opening 3 near the top end of the flagpole. If the halyard 5 is fixed thereto approximately halfway up the flagpole 2, the top edge of a flag 7 can reach just to the ground when it is being lowered.

The embodiments illustrated here show a cage structure 8 which is disposed above the weight 6, but a structure the other way round is also possible. Instead of using the cage structure 8, it is also possible to provide the weight 6 with passage openings for the locking pin 10, while in the exemplary embodiment of FIGS. 3A and 3B such facilities can in principle be omitted.

Figure 5:
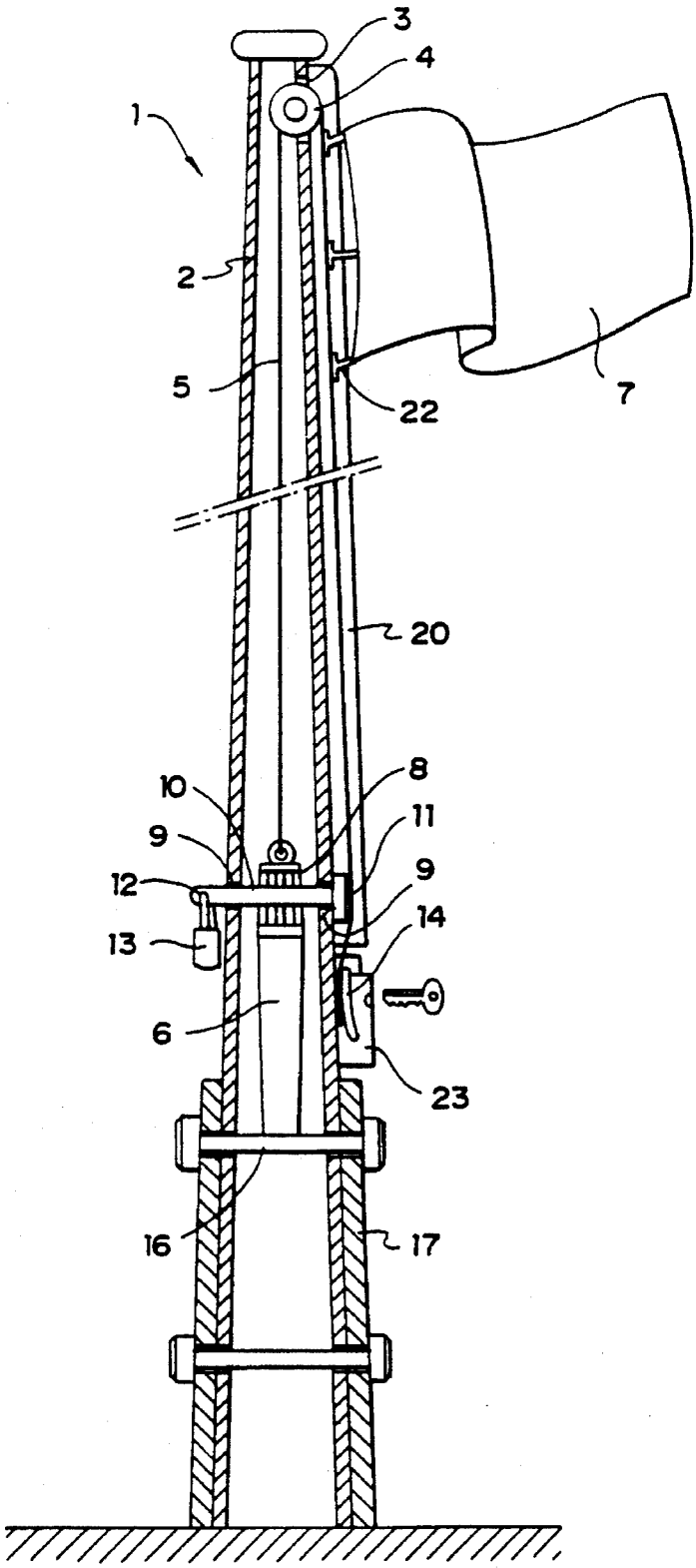
FIG. 5 shows an alternative embodiment of the profile shut-off element and locking pin in the flagpole assembly.

Although in the embodiment described in FIGS. 3A and 3B the position of the weight 6 inside the pole 2 is fixed by means of the fixing bracket 14 and the locked shut-off element 23, it is also possible to combine the embodiment shown in FIGS. 3A and 3B with the embodiments of FIGS. 1, 2 and 4, in which case a padlock 13 can then be provided either inside or outside the locked shut-off element 23. FIG. 5 shows the profile shutoff element used with a locking pin through the halyard weight.

FIGS. 3A and 3B show a situation in which the guide profile 20 is fitted on the flagpole 2. It goes without saying that such a profile can also be incorporated in the pole.

Although an ordinary flag 7 is used in the exemplary embodiments shown here, the invention can also be used with an advertising flagpole, especially an advertising flagpole provided with means enabling the flagpole to rotate around the longitudinal axis thereof, the advertising flagpole having a flag or banner with stretching arm. In this case a flag or banner with a hem pushed over a stretching arm is raised on the stretching arm in the above-described way by means of a weight which is connected to the halyard inside the pole.

What is claimed is:

1. Flagpole assembly, at least comprising an at least partially hollow flagpole with a top end, a bottom end and an outer surface, a halyard guided at least partially through the interior of the flagpole, said halyard having first and second ends, and first halyard fixing means connected to said outer surface of said flagpole, the flagpole being provided near its top end with at least a halyard passage opening and first halyard guide means, while in the interior of the flagpole the halyard interacts with a halyard weight, said flagpole assembly further comprising securing means selectively engageable between said halyard and said flagpole for preventing unauthorized lowering of the flag and for fixing the position of the halyard weight in at least the hoisted position of the flag.

2. Flagpole assembly according to claim 1, wherein, said securing means comprise a locking pin for insertion through at least one opening in the flagpole and through an opening in the halyard weight, and locking means for securing said locking pin to said flagpole.

3. Flagpole assembly according to claim 2, wherein, said securing means also comprise a rod, which on the one end is connected to the first end of the halyard which is outside the flagpole, and which at the other end, away from the first end of the halyard is provided with an eye through which the locking pin can be inserted.

4. Flagpole assembly according to claim 1, wherein, said securing means comprise a profile disposed on the pole in the lengthwise direction of said pole and having at least one open end facing the first halyard fixing means, and a profile shut-off element selectively attachable to said flagpole adjacent said open end of said profile for shutting off the open end facing the first halyard fixing means, said profile being of such a shape that a halyard guided through the profile is not accessible from the outside, and said profile shut-off element, when placed against the open end of the profile facing the first halyard fixing means, shutting off the first halyard fixing means and the first end of the halyard projecting from the profile in such a way that they are essentially inaccessible.

5. Flagpole assembly according to claim 1, wherein, said securing means comprise a locking pin for insertion through at least one opening in the flagpole and through an opening in the halyard weight, said locking pin having a portion projecting from the opening in the flagpole, a profile disposed on the pole in the lengthwise direction of said pole and having at least one open end facing the first halyard fixing means, and a profile shut-off element for shutting off the open end facing the first halyard fixing means, said profile being of such a shape that a halyard guided through the profile is not accessible from the outside, and said profile shut-off element, when placed against the open end of the profile facing the first halyard fixing means, shutting off the first halyard fixing means, and the first end of the halyard projecting from the profile in such a way that they are essentially inaccessible.

6. Flagpole assembly according to claim 5, wherein said profile shut-off element, when placed against the open end of the profile facing the first halyard fixing means also shuts off the part of the locking pin projecting from the opening in the flagpole in such a way that said locking pin is essentially inaccessible.

7. Flagpole assembly according to one of claims 4–6, wherein the profile shut-off element comprises locking means for locking together the profile shut-off element and at least one of the flagpole and the profile in the position in which they are placed.

* * * * *